US011676779B2

(12) United States Patent
Ruff

(10) Patent No.: US 11,676,779 B2
(45) Date of Patent: Jun. 13, 2023

(54) KEY MODULE TRIGGER ELEMENT HAVING MORE THAN ONE CONTACT FINGER EACH WITH DIFFERING PRE-TRAVEL PATHS

(71) Applicant: Cherry GmbH, Auerbach/Opf (DE)

(72) Inventor: Eduard Ruff, Auerbach (DE)

(73) Assignee: CHERRY GMBH, Auerbach/Opf (DE)

( * ) Notice: Subject to any disclaimer, the term of this patent is extended or adjusted under 35 U.S.C. 154(b) by 0 days.

(21) Appl. No.: 17/272,733

(22) PCT Filed: Sep. 10, 2019

(86) PCT No.: PCT/EP2019/074041

§ 371 (c)(1),
(2) Date: Mar. 2, 2021

(87) PCT Pub. No.: WO2020/053177

PCT Pub. Date: Mar. 19, 2020

(65) Prior Publication Data

US 2021/0366673 A1 Nov. 25, 2021

(30) Foreign Application Priority Data

Sep. 13, 2018 (DE) ..... 10 2018 122 416.8
Apr. 5, 2019 (DE) ..... 10 2019 108 956.5
Jun. 19, 2019 (DE) ..... 10 2019 116 585.7

(51) Int. Cl.
*H01H 13/78* (2006.01)
*G10H 1/34* (2006.01)
(Continued)

(52) U.S. Cl.
CPC ..... *H01H 13/78* (2013.01); *G10H 1/344* (2013.01); *H01H 1/28* (2013.01); *H01H 3/12* (2013.01);
(Continued)

(58) Field of Classification Search
CPC ..... G10H 1/344; H01H 2235/00; H01H 2225/01; H01H 2203/044; H01H 13/78; H01H 13/807; H01H 3/12; H01H 1/28
See application file for complete search history.

(56) References Cited

U.S. PATENT DOCUMENTS 983,722 A 2/1911 Johansen
4,220,835 A * 9/1980 Storz ..... H01H 13/36 200/283
(Continued)

OTHER PUBLICATIONS

International Search Report for PCT/EP2019/074041 dated Nov. 8, 2019.

*Primary Examiner* — Vanessa Girardi
(74) *Attorney, Agent, or Firm* — James R. Hayne; Stites & Harbison PLLC

(57) ABSTRACT

What is presented is a key module for a keyboard. The key module comprises a key tappet. The key module also comprises a module housing. The module housing is formed to movably accommodate the key tappet, in order to enable a translational actuation movement of the key tappet between a rest position and in an actuated position relative to the module housing. The key module further comprises a trigger element for triggering an actuation signal of the key module in response to the actuation movement. The trigger element is attached to the key tappet. The trigger element is a contactor for electrically shorting contact pads of a circuit substrate of the keyboard. The trigger element comprises more than two elastically deformable contact fingers for contacting the contact pads after different pre-travel paths in the course of the actuation movement.

15 Claims, 8 Drawing Sheets

(51) Int. Cl.
*H01H 1/28* (2006.01)
*H01H 3/12* (2006.01)

(52) U.S. Cl.
CPC ... *H01H 2203/044* (2013.01); *H01H 2225/01* (2013.01); *H01H 2235/00* (2013.01)

(56) References Cited

U.S. PATENT DOCUMENTS

| | | | |
|---|---|---|---|
| 5,952,629 | A | 9/1999 | Yoshinaga et al. |
| 2016/0163478 | A1 | 6/2016 | Grange et al. |
| 2018/0121505 | A1 | 5/2018 | Barsness et al. |
| 2018/0137997 | A1 | 5/2018 | Wang et al. |
| 2020/0043680 | A1 | 2/2020 | Ruff |

* cited by examiner

KEY MODULE TRIGGER ELEMENT HAVING MORE THAN ONE CONTACT FINGER EACH WITH DIFFERING PRE-TRAVEL PATHS

The present invention relates to a key module for a keyboard, to a keyboard with at least one such key module, and to a method for recognizing actuation of a key module of a keyboard.

Different types of key switches may be employed in keyboards exemplarily used in connection with computers. In particular, mechanical key modules can be used as a key switches. In particular, mechanical key modules may be used as key switches.

There are different types of mechanical key modules. A key module having a lid element, a tappet, a contact element unit, a contact piece and a housing element is described in post-published DE 10 2017 106 406 A1.

Against this background, the present invention provides an improved key module for a keyboard, an improved keyboard, and an improved method for recognizing actuation of a key module for a keyboard with a wire bracket for providing tactile and/or acoustic feedback according to the main claims. Advantageous embodiments can be seen from the dependent claims and the subsequent description.

According to embodiments, in particular, a type of actuation in which several switch points may be reached after each other during an actuation movement may be provided in a key module for a keyboard, in order to enable several different actuation signals for several different functions. For example, this may be achieved by way of a contactor with three or more contact fingers formed and arranged so that different contacts are closed after different pre-travel paths of the actuation movement.

Advantageously, in particular, several switch points may be realized by means of a single key module, in order to execute several functions, commands or actions by actuating a single key module, for example. Thus, in particular, early contact may be established after a short pre-travel path for a function required frequently and additionally or alternatively quickly, and later contact may be established after a longer pre-travel path for a function required less frequently and additionally or alternatively later. The several switch points may be realized by means of a space-saving, inexpensive and easily producible component in a robust and reliable manner, in particular.

What is presented is key module for a keyboard, wherein the key module comprises:

a key tappet;

a module housing, wherein the module housing is formed to movably accommodate the key tappet, in order to enable a translational actuation movement of the key tappet between a rest position and an actuated position relative to the module housing; and a trigger element for triggering an actuation signal of the key module in response to the actuation movement, wherein the trigger element is attached to the key tappet, wherein the trigger element is a contactor for electrically shorting contact pads of a circuit substrate of the keyboard, wherein the trigger element comprises more than two elastically deformable contact fingers for contacting the contact pads after different pre-travel paths in the course of the actuation movement The keyboard may be provided for a computer or the like, for example. The keyboard may comprise at least one key module. The key module may be part of a key or may represent a key. Thus, one key module per key may be provided. The key module may also be referred to as a mechanical push-button or mechanical push-button switch. The circuit substrate may be a circuit board. The keyboard may comprise the circuit substrate. The circuit substrate may comprise a plurality of contact pads. The key tappet may be integrally formed. The key tappet may comprise a coupling portion for coupling to a keycap for the key module. The contactor or trigger element may be integrally formed. At least to the contact fingers may be formed of electrically conductive material. In particular, the contactor may be integrally formed as a stamped and bent part. The contact fingers may have a linear or progressive spring characteristic upon deformation. In the rest position, the contact fingers may be spaced from the circuit substrate. In the actuated position, the contact fingers may contact the contact pads of the circuit substrate. Contact between contact finger and the contact pad may be effected while generating friction. After a first pre-travel path, a subset of the contact fingers may contact a subset of the contact pads, and after a second pre-travel path, all contact fingers may contact the contact pads. Here, the second pre-travel path may be greater than the first pre-travel path. After the second pre-travel path, the key tappet may be arranged more closely to the actuated position than after the first pre-travel path. Upon contact between the contact fingers and the contact pads, different circuits in the circuit substrate may be closed.

According to an embodiment, the contact fingers may be formed to contact at least two of the contact pads with a distance offset with respect to each other and additionally or alternatively in a freely pre-definable sequence in the course of the actuation movement. Thus, at least two different contact pads may be contacted by contact fingers after each other in the course of the actuation movement up to the actuated position. An order of contacting here is arbitrarily definable by a corresponding shape of the contact fingers. Such an embodiment offers the advantage that a key module may be configured with functions in an easy, application-specific and flexible way.

According to an embodiment, the trigger element may comprise three elastically deformable contact fingers. Here, a first contact finger may be formed to contact a first contact pad after a first pre-travel path. A second contact finger may be formed to contact a second contact path after the first pre-travel path. Furthermore, a third contact finger may be formed to contact a third contact pad after a second pre-travel path. The second pre-travel path may be longer than the first pre-travel path. The first contact finger and the second contact finger may contact the first contact pad and the second contact pad before the third contact pad is contacted by the third contact finger. Such an embodiment offers the advantage that to switch points or actuation points of the key module can be realized in a simple and reliable way.

According to an embodiment, the trigger element may comprise three elastically deformable contact fingers. Here, a first contact finger and a second contact finger may be bent at a first angle relative to a body of the trigger element. A third contact finger may be bent at a second angle relative to the body of the trigger element. The first angle may be greater than the second angle. The first angle and the second angle may be present in the rest position. Such an embodiment offers the advantage that the contacting of the contact pads taking place after different pre-travel paths can be achieved in an inexpensive and fatigue-endurable way by means of the differently bent contact fingers.

According to an embodiment, the trigger element may comprise three elastically deformable contact fingers. Here, a first contact finger and a second contact finger may be formed as subsections of a first finger portion of the trigger element, and a third contact finger may be formed as a second finger portion of the trigger element. Additionally or alternatively, a separation gap between the first contact finger and the second contact finger may be shorter than a separation gap between the second contact finger and the third contact finger. Such an embodiment offers the advantage that a short between the first contact pad and the second contact pad can be achieved permanently at the same time or within a small temporal tolerance range, wherein the different bending of the third contact finger relative to the other two contact fingers can be simplified.

Furthermore, each of the contact fingers may comprise a bent end portion for contacting one of the contact pads. In particular, the first contact finger may comprise a first bent end portion for contacting the first contact pad, the second contact finger may comprise a second bent end portion for contacting the second contact pad, and the third contact finger may comprise a third bent end portion for contacting the third contact pad. Such an embodiment offers the advantage that safety of contact can be enhanced.

According to an embodiment, the key module may comprise a wire bracket for providing tactile and additionally or alternatively acoustic feedback. Here, the wire bracket may be elastically deflectable in the course of the actuation movement. The wire bracket may be bent with an overall bending angle of less than 360 degrees. The wire bracket may be fixed to the key tappet. The wire bracket may be bent from a metal wire having a predefined diameter. The wire bracket may be formed to provide the tactile and/or acoustic feedback in the course of the actuation movement. The overall bending angle may correspond to a sum of bending angles of all bending locations of the wire bracket at which the wire bracket is bent. The wire bracket may also be referred to as a clip, click bracket or generally as an elastic means. The wire bracket may be formed of metal wire or plastics wire. Such an embodiment offers the advantage that tactile and additionally or alternatively acoustic feedback can be provided in an inexpensive, robust, uncomplicated and reliable manner.

According to an embodiment, the module housing may be integrally formed. The module housing may comprise at least one positioning protrusion for positioning the key module on the circuit substrate of the keyboard. The module housing may comprise at least one mounting portion for mounting the key module in the keyboard with positive locking and additionally or alternatively non-positive locking. The positioning protrusion may be formed as a stud, a pin or the like. The mounting portion may be formed as a flange and additionally or alternatively a snap-fit or the like. The key module may be connected to the circuit substrate while avoiding an adhesive bond between the key module and the circuit substrate of the keyboard. Such an embodiment offers the advantage that a solder-free connection between the key module and the circuit substrate can be realized in a cost-saving manner. Cost may also be saved because a wider selection of materials, also including less temperature-resistant materials, can be used for the key module depending on the ambient temperature of the operational environment. Moreover, a solder-free connection offers simple replacement of key modules by an expert or directly by the end user. This opens up an additional possibility of individual keyboard design, which may be advantageous particularly with gaming users.

The key tappet may also comprise elastic means. The elastic means may be formed to bias the key tappet into the rest position in an assembled state the key module. The elastic means may be formed as a compression spring. The elastic means may function as a return spring for the key module. The elastic means may effect a linear force-displacement characteristic in the course of the actuation movement. In other words, the elastic means may have a linear spring characteristic. As an alternative, the elastic means may have a progressive spring characteristic. Among other things, a force-displacement characteristic of an actuation of the key module can be advantageously adjusted as needed by elastic means.

Moreover, the key tappet may be formed of translucent material or opaque material. The module housing may be formed of translucent material or opaque material. Such an embodiment offers the advantage that uniform illumination of a keycap coupleable to the key tappet can be achieved from the circuit substrate. Also, illumination of the entire module housing, and thus an environment of the keycap, can be enabled if required.

According to an embodiment, the module housing may comprise an abutment surface. The trigger element may be arranged so as to abut on the abutment surface in the rest position of the key tappet. The abutment surface may be formed at least so that the trigger element and thus the key tappet can be prevented from sliding back to a position prior to first-time actuation. Such an embodiment offers the advantage that settling vibrations of the trigger element after returning from the actuation position to the rest position can be dampened.

What is also presented is a keyboard, wherein the keyboard comprises:

at least one exemplar of an embodiment of the previously presented key module; and the circuit substrate with the contact pads, wherein the at least one key module is arranged on the circuit substrate.

Thus, at least one previously presented key module may be employed or used in conjunction with the keyboard. The at least one key module may be attached directly to the circuit substrate. The contact pads may be electrically connected to each other via the contact fingers when the at least one key module is actuated. Here, respective circuits in the circuit substrate may be closed.

According to an embodiment, the keyboard may comprise a device for recognizing actuation of the key module. The device may be connected to the circuit substrate for signal transmission. The device may comprise a detector for detecting a number of contact pads of the circuit substrate of the keyboard contacted by the contact fingers and a provider for providing a first actuation signal in response to a detected first number of contact pads contacted by the contact fingers and a second actuation signal in response to a second number different from the first number of contact pads contacted by the contact fingers. Each of the actuation signals may represent a recognized actuation of the key module. The device may be arranged inside or outside a housing of the keyboard. The actuation signals may be processed signals. As an alternative, the actuation signals may also be contact signals representing closing of a circuit or electric circuit in the circuit substrate. Such an embodiment offers the advantage that key actuation can be recognized in a reliable and accurate manner, with distinguishing between different types of key actuation also being enabled to obtain different actuation signals.

The detector may be configured to detect at least a time interval between contact time instants at which different contact pads are contacted by the contact fingers. The provider may be configured to provide at least one further actuation signal depending on the at least one detected time interval using a determination rule. The at least one further actuation signal may represent a recognized actuation of the key module. More specifically, the detector may be configured to measure at least one time interval between closing processes of circuits occurring upon contact between contact pads and contact fingers. As the respective pre-travel paths at which the contact pads are contacted by the contact fingers are known, the device may also be configured to determine a velocity and additionally or alternatively an acceleration of the actuation movement. The determination rule may comprise a threshold value comparison, a lookup table, use of physical equations of motion and the like. Such an embodiment offers the advantage that special actuation signals can also be triggered depending on actuation movement dynamics caused by a user, for example different actuation signals at different actuation velocities or accelerations.

The contact pads may also be electrically insulated from each other. Additionally or alternatively, the contact pads may be arranged along a straight line. Such an embodiment offers the advantage that a simple and widely available design of the circuit substrate can be used.

According to an embodiment, the at least one key module and the circuit substrate may be connected to each other exclusively with positive locking and additionally or alternatively with non-positive locking. The positive locking and additionally or alternatively the non-positive locking between key module and circuit substrate may be affected by means of the at least one positioning protrusion and at least one mounting portion of the module housing. Such an embodiment offers the advantage that a reliable, inexpensive connection simply detachable for replacement can be realized.

Furthermore, the keyboard may comprise a fixing element for fixing the at least one key module to the circuit substrate. The fixing element may be formed as a key frame between the circuit substrate and a keyboard top or as a keyboard top. The fixing element may be configured to engage in positive and additionally or alternatively non-positive locking with at least one mounting portion of the module housing of the key module. Such an embodiment offers the advantage that a keyboard can be realized inexpensively, wherein long-life and robust key modules can be replaced easily and allow for precise actuation.

What is also presented is a method for recognizing actuation of a key module of an embodiment of the previously mentioned keyboard, wherein the method comprises the steps of:

detecting a number of contact pads of the circuit substrate of the keyboard contacted by the contact fingers; and providing a first actuation signal in response to a detected first number of contact pads contacted by the contact fingers and a second actuation signal in response to a detected second number different from the first number of contact pads contacted by the contact fingers, wherein each of the actuation signals represents a recognized actuation of the key module.

The method may be executed advantageously in conjunction with or using an embodiment of the previously mentioned keyboard with at least one exemplar of an embodiment of the previously mentioned key module. The first actuation signal and the second actuation signal may be different from each other. Here, the first actuation signal and the second actuation signal may have different signal values. The first number of contact pads may correspond to a subset of the contact pads contacted by a subset of the contact fingers after the first pre-travel path. The second number of contact pads may correspond to all contact pads, which are contacted by all contact fingers after a second pre-travel path. Here, the second pre-travel path maybe longer or greater than the first pre-travel path. The first actuation signal may be configured to trigger a first function when used by a device connected to the keyboard for signal transmission. The second actuation signal may be configured to trigger a second function different from the first function when used by a device connected to the keyboard. Transmission. The actuation signals may be processed signals. As an alternative, the actuation signals may also be contact signals representing closing of a circuit or electric circuit in the circuit substrate.

According to an embodiment, at least a time interval between contact time instants at which different contact pads are contacted by the contact fingers may be detected in the step of detecting. Furthermore, in the step of providing, at least one further actuation signal may be provided depending on the at least one detected time interval using a determination rule. The at least one further actuation signal may represent a recognized actuation of the key module.

The invention shall be explained in greater detail by way of example on the basis of the attached drawings, in which.

In the subsequent description of preferred embodiments of the present invention, the same or similar reference numerals shall be used for similarly acting elements illustrated in the various figures, wherein repeated description of these elements shall be omitted.

Figure 1:
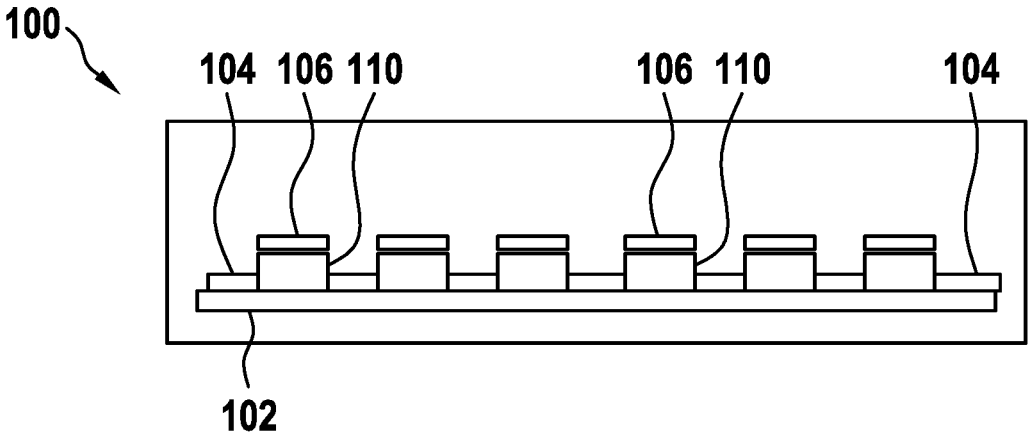
FIG. 1 shows a schematic illustration of a keyboard according to an embodiment of the present invention.

FIG. 1 shows a schematic illustration of a keyboard 100 with key modules 110 according to an embodiment. For example, the keyboard 100 is part of a notebook computer, laptop computer or the like. Alternatively, the keyboard 100 is designed as a peripheral device for a computer, in particular.

The keyboard 100 comprises a circuit substrate 102. The circuit substrate 102 is a circuit board, conductor board or the like, for example. According to the embodiment illustrated in FIG. 1, the keyboard 100 comprises a plurality of key modules 110. The key modules 110 are arranged on the circuit substrate 102.

According to the embodiment illustrated in FIG. 1, the keyboard 100 also comprises a fixing element 104 for fixing the key modules 110 to the circuit substrate 102. More specifically, the fixing element 104 is formed to establish positive locking and additionally or alternatively non-positive locking with the key module. Herein, the fixing element 104 is only exemplarily formed as a key frame. Alternatively, the fixing element 104 may be formed as a keyboard top.

Furthermore, according to the embodiment shown and described in FIG. 1, a keycap 106 is attached to each key module 110. Each keycap 106 is coupled to a key module 110 of its own. Each unit of key module 110 keycap 106 represents a key of the keyboard 100. Alternatively, each key module 110 represents a key of the keyboard 100. Particularly the key modules 110 shall be explained in greater detail with reference to subsequent figures.

The keycap 106 represents a part of a key visible and touchable for a user of the keyboard 100. Actuation of a key module 110 is effected by pressing onto the keycap 106. Each key module 110 is configured to react with a force-displacement characteristic of resistance or reset force to an actuation force. Furthermore, each key module 110 is configured to establish an electrical connection in response to actuation with a pre-definable actuation path, thereby executing a switching procedure with several switching points after different pre-travel paths.

According to an embodiment, the circuit substrate 102 may comprise a hole into which at least one procession protrusion of the key module 110 may be inserted. In particular, positive locking between the key module and the circuit substrate 102 may be achieved. Also, at least one light-emitting diode for illuminating the at least one key module 110 and additionally or alternatively further electronic devices may be arranged on or in the circuit substrate 102. The at least one light-emitting diode and/or the further electronic devices may be arranged by means of a surface mounting process or a soldering process. The further electronic devices may be resistors, diodes and the like.

Figure 2:
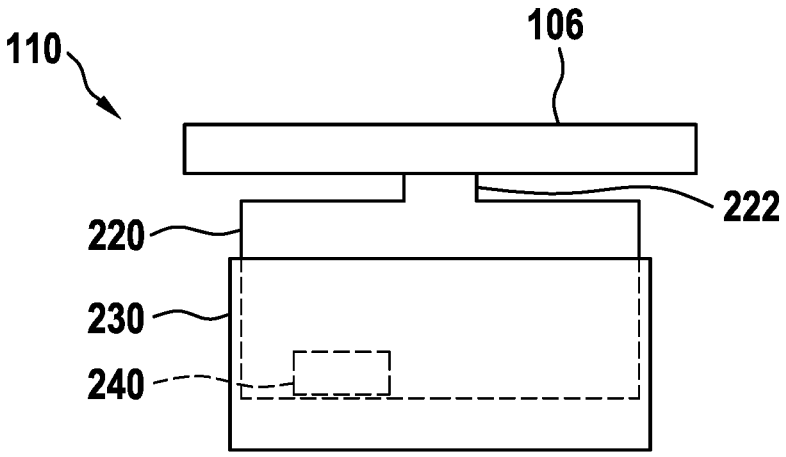
FIG. 2 shows a schematic illustration of a key module according to an embodiment of the present invention.

FIG. 2 shows a schematic illustration of a key module 110 according to an embodiment of the present invention. The key module 110 corresponds to or is similar to one of the key modules from FIG. 1. The key module 110 is provided for a keyboard like the keyboard from FIG. 1. In the illustration of FIG. 2, a key tappet 220 with a coupling portion 222, a module housing 230 and a trigger element 240 as well as a keycap 106 of the key module 110 are shown.

The module housing 230 is formed to movably accommodate the key tappet 224 a translational actuation meant of the key tappet 220 between a rest position and actuated position relative to the module housing 230. In the illustration of FIG. 2, the key tappet 220 is shown in the rest position, wherein the key tappet 220 is partially accommodated in the module housing 230. In other words, a first subsection of the key tappet 220 is accommodated in the module housing 230 in the rest position. A second subsection of the key tappet 220 is accommodated in the module housing 230 in the actuated position, wherein the second subsection is greater than the first subsection.

The trigger element 240 is attached, arranged or mounted to the key tappet 220. The trigger element 240 is formed to trigger an actuation signal of the key module 110 in response to the actuation movement. More specifically, the trigger element 240 is a contactor for electrically shorting contact pads of a circuit substrate of the keyboard. Even though it is not explicitly shown in FIG. 2, the trigger element 240 comprises more than two elastically deformable contact fingers for contacting the contact pads after different pre-travel paths in the course of the actuation movement. In other words, an increasing number of contact fingers comes into contact with contact pads of the circuit substrate in the course of the actuation movement from the rest position to the actuated position. Particularly the trigger element 240 shall be explained in greater detail with reference to figures described in the following.

The key tappet 220 comprises the coupling portion 222. The coupling portion 222 is formed to be mechanically coupleable to the keycap 106 for the key module 110. The coupling portion 222 extends along an axis of movement of the actuation movement. According to an embodiment, the coupling portion 222 may have a cruciform cross-sectional profile.

Figure 3A:
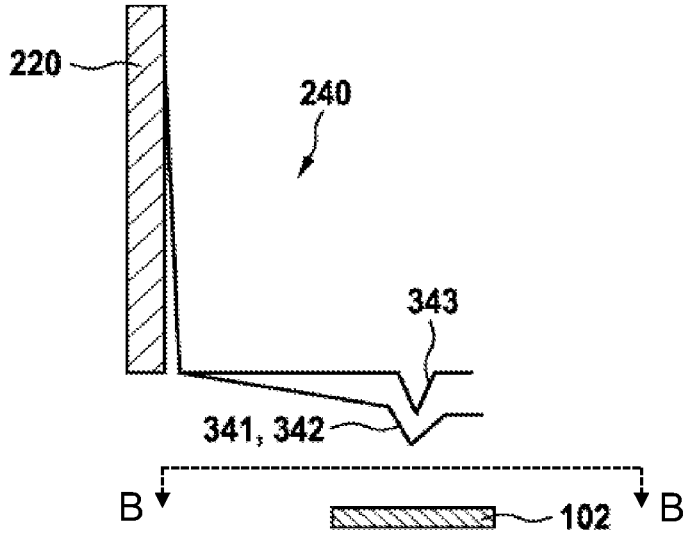
FIG. 3A shows a schematic illustration of a subsection of the keyboard from FIG. 1 and of a subsection of the key module from FIG. 2 in a rest position or contactless state.
Figure 3B:
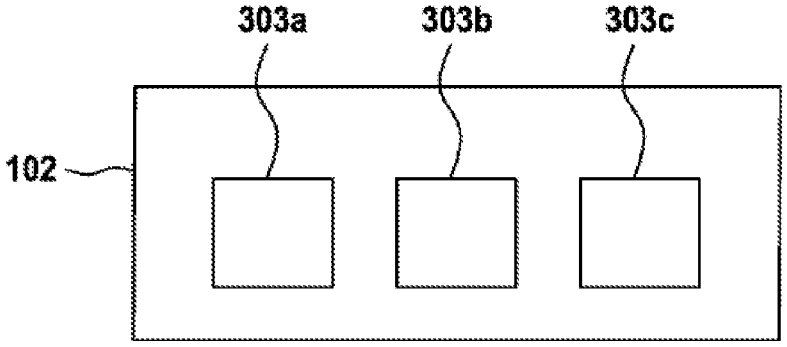
FIG. 3B shows a sectional view taken along line B-B shown in FIG. 3A.

FIG. 3A and FIG. 3B show schematic illustrations of a subsection of the keyboard from FIG. 1 and of a subsection of the key module from FIG. 2 in a rest position or contactless state. Here, FIG. 3A shows the key tappet 220 and the trigger element 240 of the key module and the circuit substrate 102 of the keyboard in the rest position of the key module. Here, the key module is in a contactless state, wherein the trigger element 240 and the circuit substrate 102 are spaced from each other. The trigger element 240 comprises three elastically deformable contact fingers 341, 342 and 343. A first contact fingers 341 and a second contact fingers 342 are bent at a first angle relative to a body of the trigger element 240 in the rest position. A third contact finger 343 is bent at a second relative to the body of the trigger element 240 the rest position. The first angle, at which the first contact finger 341 and the second contact finger 342 are bent relative to the body, is greater than the second angle, at which the third contact finger 343 is bent relative to the body. By way of example only, the first angle here is an obtuse angle, and the second angle is a right angle. FIG. 3B shows a schematic top view onto the circuit substrate 102 of the keyboard with three contact pads 303*a*, 303*b* and 303*c*. The contact pads 303*a*, 303*b* and 303*c* are arranged along a straight line. In particular, the contact pads 303*a*, 303*b* and 303*c* also are electrically insulated from each other. A first contact pad 303*a* can be contacted by the first contact finger 341, a second contact pad 303*b* can be contacted by the second contact finger 342, and a third contact pad 303*c* can be contacted by the third contact finger 343.

Figure 4A:
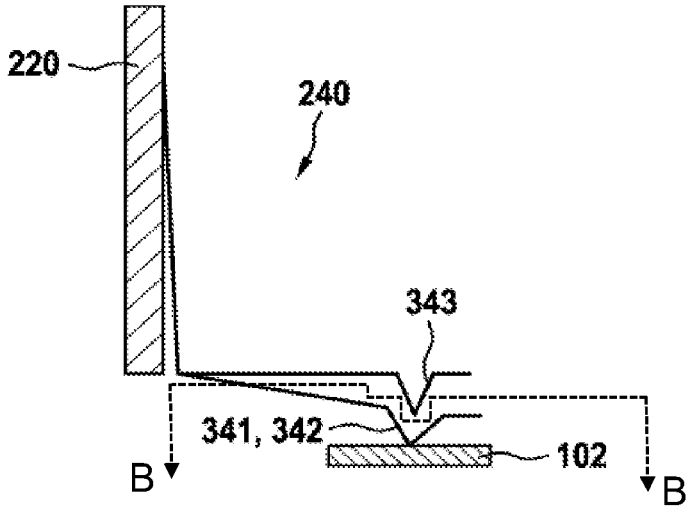
FIG. 4A shows a schematic illustration of the subsection of the keyboard and of the subsection of the key module from FIG. 3A in a first actuator position or at a first switching point.
Figure 4B:
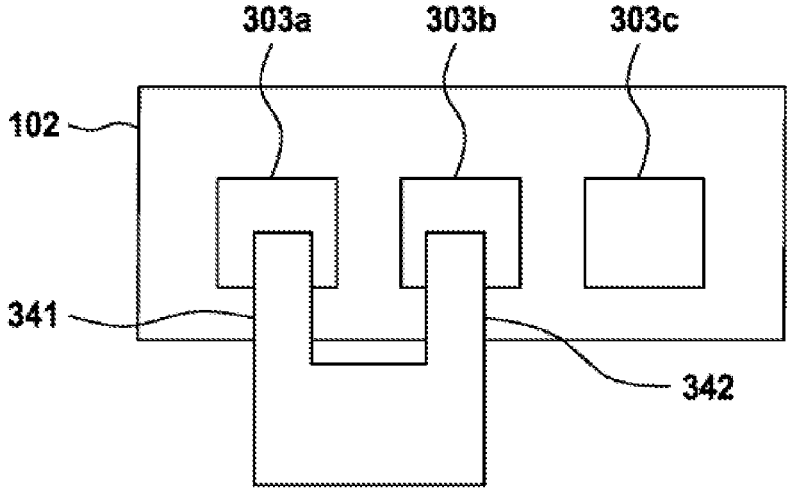
FIG. 4B shows a sectional view taken along line B-B shown in FIG. 4A.

FIG. 4A and FIG. 4B show schematic illustrations of the subsection of the keyboard and of the subsection of the key module from FIG. 3A and FIG. 3B in a first actuator position or at a first switching point. The first actuated position represents a partially actuated state of the key module. A first switching point of the key module is reached or realized here. Starting from the rest position of FIG. 3A, the key tappet 220 with the trigger element 240 is moved by a first pre-travel path or a first actuation distance relative to the circuit substrate 102 in the direction of the circuit substrate 102 in the illustration of FIG. 4A. FIG. 4A here corresponds to FIG. 3A, except that the first contact finger 341 and the second contact finger 342 are arranged in contact with the circuit substrate 102. The first contact finger 341 and the second contact finger 342 are configured and formed to realize the first switching point. The third contact finger 343 is spaced from the circuit substrate 102. In FIG. 4B it is shown that the first contact finger 341 contact the first contact pad 303*a* and that the second contact finger 342 contact the second contact pad 303*b*. Here, the first contact pad 303*a* and the second contact pad 303*b* are shorted by the trigger element 240, particularly by the first contact finger 341 and the second contact finger 342.

Figure 5A:
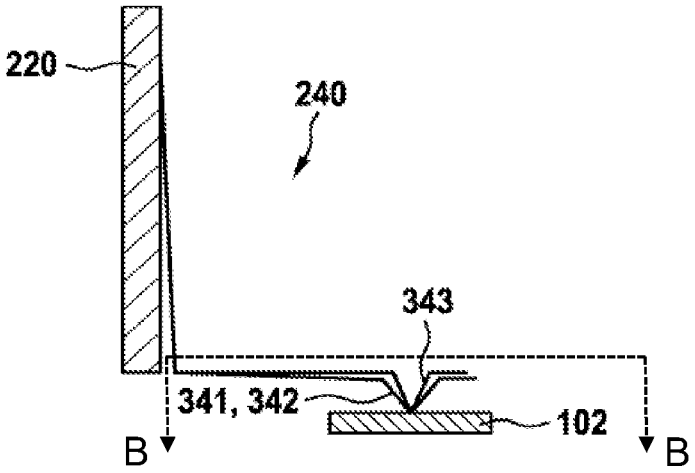
FIG. 5A shows a schematic illustration of the subsection of the keyboard and of the subsection of the key module from FIG. 3A or FIG. 4A in a second actuated position or at a second switching point.
Figure 5B:
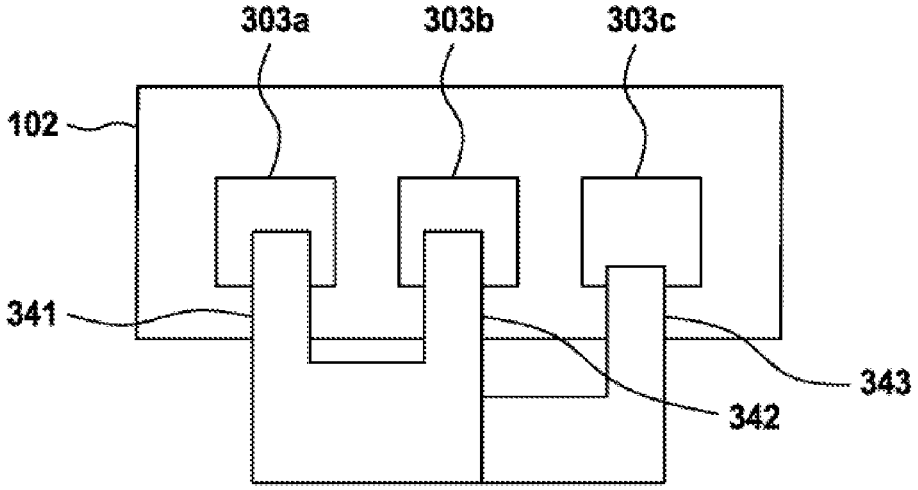
FIG. 5B shows a sectional view taken along line B-B shown in FIG. 5B.

FIG. 5A and FIG. 5B show schematic illustrations of the subsection of the keyboard and of the subsection of the key module from FIG. 3A and FIG. 3B or FIG. 4A and FIG. 4B in a second actuated position or at a second switching point. The second actuated position represents a completely or substantially completely actuated state of the key module. Here, a second switching point of the key module is reached or realized. Starting from the rest position of FIG. 3A, the key tappet 220 with the trigger element 240 is moved by a second pre-travel path or a second actuation distance relative to the circuit substrate 102 in the direction toward the circuit substrate 102 in the illustration of FIG. 5A. The second pre-travel path is greater than the first pre-travel path from FIG. 4A. FIG. 5A here corresponds to FIG. 4A, except that the first contact finger 341, the second contact finger 342 and the third contact finger 343 are arranged in contact with the circuit substrate 102. The third contact finger 343 is configured and formed to realize the second switching point. FIG. 4B shows that the first contact finger 341 contact the first contact pad 303*a*, the second contact finger 342 contact the second contact pad 303*b*, and the third contact finger 343 contacts the third contact pad 303*c*. here, the first contact pad 303*a*, the second contact pad 303*b* and the third contact pad 303*c* are shorted by the trigger element 240, in particular by the first contact finger 341, the second contact finger 342 and the third contact finger 343.

With reference to FIGS. 3A, 3B, 4A, 4B, 5A and 5B, it can be summarized that the trigger element 240 comprises three elastically deformable contact fingers 341, 342 and 343. The first contact finger 341 is formed to contact the first contact pad 303*a* after the first pre-travel path. The second contact finger 342 is formed to contact the second contact pad 303*b* after the first pre-travel path. The third contact finger 343 is formed to contact the third contact pad 303*c* after the second pre-travel path, which is longer than the first pre-travel path. Thus, two switching points can be realized easily for different actuation signals dependent on the pre-travel path.

Figure 6:
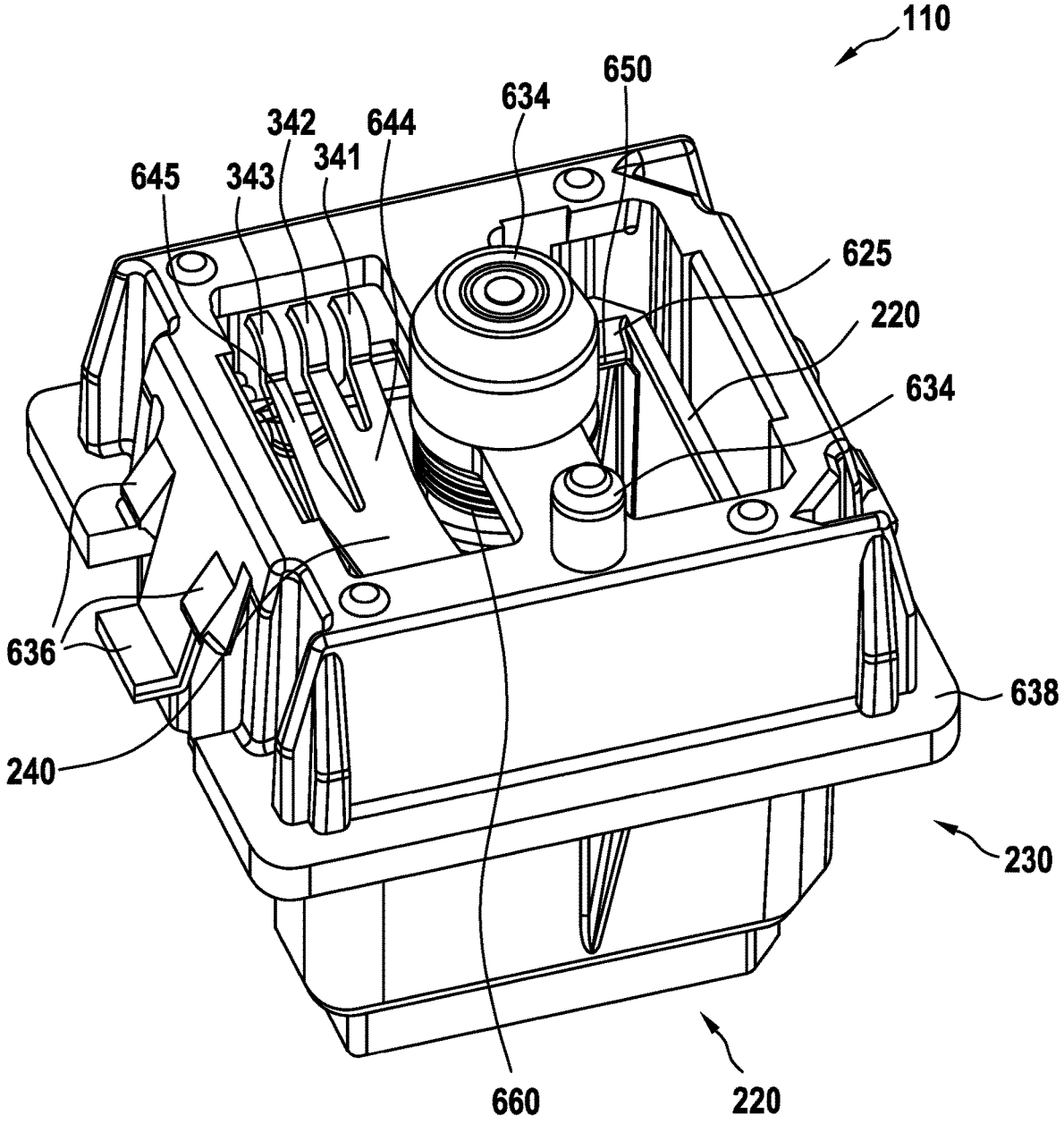
FIG. 6 shows a schematic illustration of a key module according to an embodiment of the present invention.

FIG. 6 shows a schematic illustration of a key module 110 according to an embodiment of the present invention. The key module 110 corresponds to or is similar to the key module from one of the previously described figures. In FIG. 6, the key module 110 is shown in an oblique bottom view. Here, the key tappet 220 with projection portion 625, the module housing 230 with at least one positioning protrusion 634, at least one mounting portion 636 and a flange 638, the trigger element 240 with the first contact finger 341, the second contact finger 342, the third contact finger 343, a first finger portion 644 and a second finger portion 645, a wire bracket 650 and elastic means 660 of the key module 110 are shown.

According to the embodiment illustrated here, to cutouts are formed in a bottom portion, which can be made to face the circuit substrate, of the module housing 230. Through one of the cutouts, the contact fingers 341, 342 and 343 of the contactor 240 come into contact with the circuit substrate for shorting the contact pads. Through the other one of the cutouts, for example, the key module 110 can be illuminated by means of a light-emitting diode attached to the circuit substrate, in particular from the inside or via an inside the key module 110.

The trigger element 240 is mounted in the key tappet 220. The trigger element 240 comprises the first finger portion 644 and the second finger portion 645. The first contact finger 341 and the second contact finger 342 are formed as subsections of the first finger portion 644. The third contact finger 343 is formed as the second finger portion 645. The first finger portion 341 and the second finger portion 342 are separated from each other by a separation gap shorter than a further separation gap between the second contact finger 342 and the third contact finger 343 or the first finger portion 644 and the second finger portion 645. Each of the contact fingers 341, 342 and 343 comprises a bent end portion for contacting one of the contact pads of the circuit substrate. When at least one of the contact fingers 341, 342 and 343 contact a respective contact pad, its bent end portion contacts the respective contact pad. In the illustration of FIG. 6, the contact fingers 341, 342 and 343 are shown in the second switching position like in FIG. 5A or FIG. 5B, merely as an example.

When the key module 110 is being actuated, the key tappet 220 is translationally movable relative to the module housing 230 between the rest position and the actuated position. This is referred to as the actuation movement of the key tappet 220. According to the embodiment illustrated in FIG. 6, the key tappet 220 is integrally formed. According to an embodiment, the key tappet 220 is formed of translucent material. That way, uniform illumination of a keycap can be realized. According to another embodiment, the key tappet 220 is formed of opaque material.

According to the embodiment illustrated here, the module housing 230 is integrally formed. The module housing 230 is formed to movably accommodate the key tappet 220, in order to enable the actuation movement of the key tappet 220 relative to the module housing 230. According to an embodiment, the module housing 230 is formed of translucent material. That way, ambient illumination for the keycap can be realized. According to another embodiment, the module housing 230 is formed of opaque material. This way, illumination of the key module 110 can be restricted to the keycap.

The module housing 230 comprises at least one positioning protrusion 634. According to the embodiment illustrated, the module housing 230 comprises two positioning protrusions 634. The positioning protrusions 634 formed to position the module housing 230, and hence the assembled key module 110, on a circuit substrate of the keyboard. The positioning protrusions 634 are formed as studs or pins. The positioning protrusions 634 extend along the axis of the actuation movement. According to the embodiment illustrated here, the positioning protrusions 634 are formed by bulges of the module housing 230.

According to the embodiment illustrated here, the module housing 230 also comprises a mounting portion 636 for mounting the key module 110 in the keyboard with positive locking and/or non-positive locking. The mounting portion 636 comprises latching protrusions or snap noses for snapping into the fixing element, particularly the holding opening of the fixing element of the keyboard. A flange 638 formed around the module housing 230 functions as a further mounting portion or as a stop with respect to the positive locking and/or non-positive locking.

The wire bracket 650 is fixed to the key tappet 220. The wire bracket 650 is arranged at least partially within an inside of the key tappet 220 enclosed by an outer wall of the key tappet 220. The wire bracket 650 is arranged and formed to provide tactile and/or acoustic feedback when the key module 110 is being actuated. To this end, the wire bracket 650 is elastically deflectable in the course of the actuation movement. The wire bracket 650 is bent with an overall bending angle of less than 360 degrees.

The keycap 220 comprises a projection portion 625 with a strike surface inclined normally with respect to an axis of the actuation movement. The projection portion 625 is formed as a nose. The strike surface of the projection portion 625 and the wire bracket 650 are formed and arranged to effect and impact of the wire bracket 650 on the strike surface of the projection portion 625 in the course of the actuation movement for the acoustic and/or tactile feedback.

Furthermore, the key tappet 220 may comprise a fixing portion for fixing the wire bracket 650 to the key tappet 220. Here, the fixing portion may comprise two bearing notches for supporting the wire bracket 650. Each of the bearing notches may open an angle of less than 180 degrees. The wire bracket 650 may be wedged in the fixing portions. The wire bracket 650 may be press-fit, slidable or insertable in the fixing portion. Thus, the fixing portion may function as a slide-in compartment for the wire bracket 650. The key tappet 220 may also comprise an inclined surface obliquely inclined with respect to an axis of the actuation movement. Here, the module housing 230 may comprise a rib obliquely inclined with respect to the axis of the actuation movement with a nose and an abutment surface normally inclined with respect to the axis of the actuation movement. The inclined surface, the rape, the abutment surface and the nose may be formed to elastically deflect the wire bracket 650 and suddenly release the same in the course of the actuation movement.

Also, the key tappet 220 may comprise a retaining portion for retaining the wire bracket 650 against movement away from a wall of the key tappet 220 and additionally or alternatively for retaining the wire bracket 650 against movement transversal to an axis of the actuation movement of the key tappet 220 in the course of the actuation movement. The retaining portion may be formed to be a protrusion or guiding protrusion. A subsection of the wire bracket 650 may be accommodated or accommodatable between the retaining portion and the wall of the key tappet 220. The retaining portion may be formed and arranged to effect return of a free end of the wire bracket 650 onto the strike surface of the projection portion 625 of the key tappet 220 in cooperation with the inclined surface and the rib after the actuation movement. Thus, the elastic deflection of the key tappet 220 over the course of the actuation movement can be realized in and exactly reproducible and reliable manner. In particular, a reliably reproducible clicking sound can be accomplished, because reliable return of the free end of the wire bracket 650 onto the strike surface can be achieved.

According to the embodiment illustrated here, the elastic means 660 of the key module 110 is a compression spring. In an assembled state of the key module 110, the elastic means 660 is configured to bias the keycap 220 and the rest position. The elastic means 660 can be slid over a guiding stud of the key tappet 220. Thus, the elastic means is arrangeable between the key tappet 220 the module housing 230. The elastic means 660 may also be referred to as a return spring. According to an embodiment, a linear-progressive force-displacement characteristic can be obtained in the actuation movement. The elastic means 660 comprises a linear force-displacement characteristic. From a switching point of the key module 110 onward, the trigger element 240 is increasingly preloaded and changes the force-displacement characteristic of the key module 110.

Figure 7:
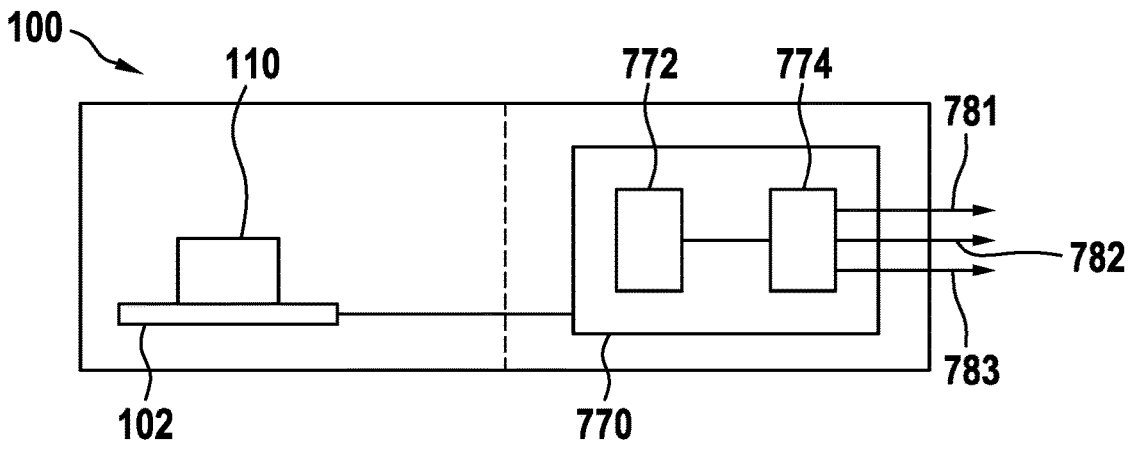
FIG. 7 shows a schematic illustration of a keyboard according to an embodiment of the present invention.

FIG. 7 shows a schematic illustration of a keyboard 100 according to an embodiment of the present invention. The keyboard 100 here corresponds to or is similar to the keyboard from FIG. 1. The circuit substrate 102, exemplarily only one key module 110, a device 770 with a detector 772 and a provider 774, an actuation signals 781, 782 and 783 of the keyboard 100 are shown in the illustration of FIG. 7. More specifically, the keyboard 100 corresponds to the keyboard from FIG. 1, except that the keyboard 100 further comprises the device 770.

The device 770 is configured to recognize actuation of the key module 110. The device 770 is connected to the circuit substrate 102 for signal transmission. The detector 772 of the device 770 is configured to detect a number of contact pads of the circuit substrate of the keyboard contacted by the contact fingers. The provider 774 of the device 770 is configured to provide a first actuation signal in response to a detected first number of the contact pads contacted by the contact fingers.

Furthermore, the provider 774 is configured to provide a second actuation signal in response to a detected second number, different from the first number, of contact pads contacted by the contact fingers. Each of the actuation signals 781 and 782 represents a recognized actuation of the key module 110. Furthermore, each of the actuation signals 781 and 782 is suitable to trigger a different function of an apparatus coupled to the keyboard or of an application coupled to the keyboard.

According to an embodiment, the detector 772 is configured to detect at least a time interval between contact time instants at which different contact pads of the circuit substrate are contacted by the contact fingers. Here, the provider is configured to provide at least a further actuation signal 783 depending on the at least one detected time interval using a determination rule. The at least one further actuation signal 783 represents a recognized actuation of the key module 110, in particular actuation with a specific velocity or acceleration.

According to the embodiment illustrated here, the device 770 is arranged within a housing of the keyboard 100. According to another embodiment, the device 770 may also be arranged outside a housing of the keyboard 100. For example, the device 770 may be part of a computer to which the keyboard 100 is connected for signal transmission.

Figure 8:
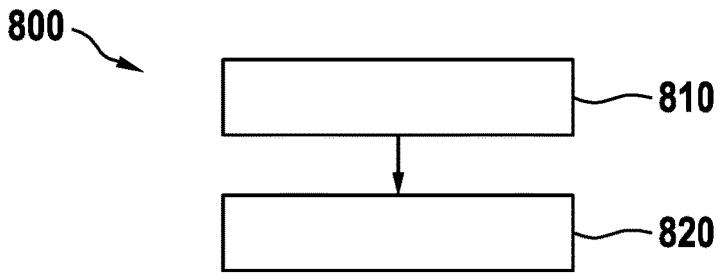
FIG. 8 shows a flowchart of a method according to an embodiment of the present invention.

FIG. 8 shows a flowchart of a method 800 for recognizing according to an embodiment of the present invention. More specifically, the method 800 is executable to recognize actuation of a key module of a keyboard corresponding to or similar to the keyboard from one of the previously described figures. In other words, the method 800 is executable to recognize actuation of a key module corresponding to or similar to the key module from one of the previously described figures.

The method 800 for recognizing comprises a step 810 of detecting and a step 820 of providing. In the step 810 of detecting, a number of contact pads of the circuit substrate of the keyboard contacted by the contact fingers is detected. In other words, in the step 810 of detecting, in particular, it is detected whether a subset of the contact pads or contact pads are contacted by the contact fingers. In response to a detected first number of contact pads contacted by the contact fingers, a first actuation signal is provided in the step 820 of providing. In other words, in the step 820 of providing, the first actuation signal is provided if the first number of contact pads contacted by the contact fingers, for example a subset of the contact pads, is detected in the step 810 of detecting. Furthermore, in response to a detected second number, different from the first number, of contact pads contacted by the contact fingers, a second actuation signal is provided in the step 820 of providing. In other words, in the step 820 of providing, the second actuation signal is provided if the second number of contact pads contacted by the contact fingers, for example all contact pads, has been detected in the step 810 of detecting. Each of the actuation signals thus represents a recognized actuation of the key module. For example, the first actuation signal represents actuation by a first pre-travel path, at which the first number of contact pads contacted by contact fingers. For example, the second actuation signal represents actuation by a second pre-travel, at which the second number of contact pads is contacted by contact fingers.

According to an embodiment, in the step 810 of detecting, at least a time interval between contact time instants at which different contact pads are contacted by the contact fingers is detected. Herein, in the step 820 of providing, at least one further actuation signal is provided depending on the at least one detected time interval using a determination rule. The at least one further actuation signal represents a recognized actuation of the key module, in particular with a specific velocity or acceleration.

Figure 9:
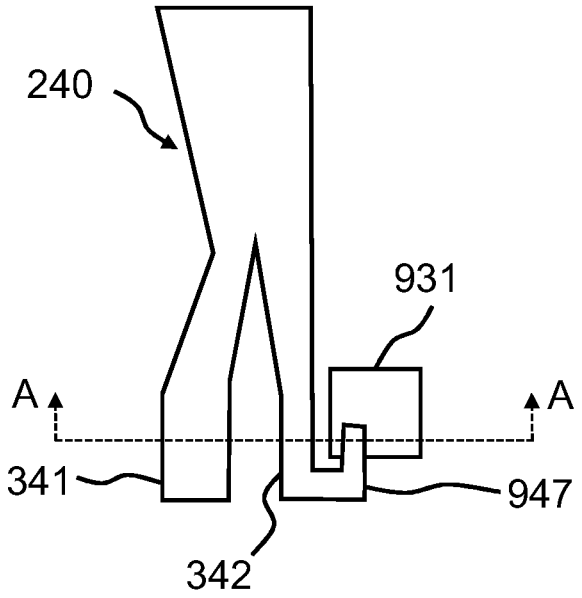
FIG. 9 shows a schematic bottom view of a subsection of a key module according to an embodiment of the present invention.

FIG. 9 shows a schematic bottom view of a subsection of the key module according to an embodiment of the present invention. In the illustration of FIG. 9, the trigger element 240 with for example only two contact fingers 341 and 342 and an abutment surface 931 of the module housing are shown of the key module. The key module in FIG. 9 corresponds to the key module from one of the previously described figures, except that the trigger element 240 comprises for example only two contact fingers 341 and 342 and the module housing comprises the abutment surface 931. The abutment surface 931 is formed and arranged so that the trigger element 240 is arranged so as to abut on the abutment surface 931 in the rest position of the key tappet of the key module.

According to the embodiment illustrated here, one of the contact fingers, merely by way of example the second contact finger 342, is arranged so as to abut on the abutment surface 931 in the rest position of the key tappet of the key module. To this end, the trigger element 240 has a rest portion 947 on the contact finger 342 in question. In the rest position, there is mechanical contact between the rest portion 947 and the abutment surface 931. In other words, the rest portion 947 abuts on the abutment surface 931 in the rest position.

By the trigger element 240 or the contactor abutting on the abutment surface 931 as a stop in the rest position, undesired vibrations of the trigger element 240, in particular also of the contact fingers 341 and 342, can be dampened or prevented.

Figure 10:
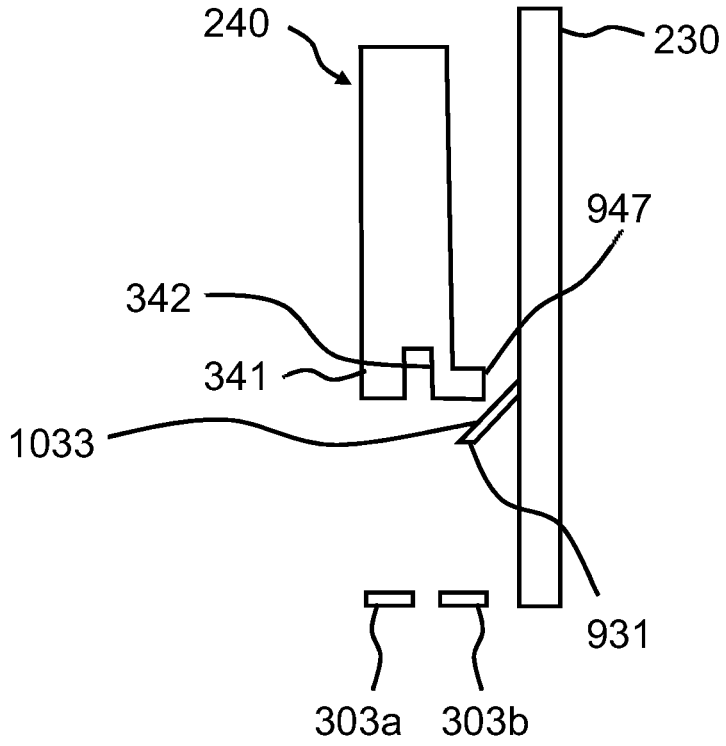
FIG. 10 shows a partially sectional view taken along line A-A in FIG. 9 of the subsection of a keyboard from FIG. 9 according to an embodiment of the present invention with a key module prior to assembly or first-time actuation.

FIG. 10 shows a partially sectional view of a subsection of a keyboard according to an embodiment of the present invention with a key module prior to assembly or first-time actuation. The keyboard is the keyboard from one of the previously described figures. The key module corresponds to or resembles the key module from FIG. 9, wherein in FIG. 10 a sidewall of the module housing 230 with a damper portion comprising the abutment surface 931 and an inclined surface 1033 and the trigger element 240 with the for example only two contact fingers 341 and 342 and the rest portion 947 are shown of the key module and additionally two contact pads 303*a* and 303*b* of the circuit substrate are shown of the keyboard.

In FIG. 10, what is shown is a state prior to assembly or first-time actuation of the key module of the keyboard. Prior to the assembly or first-time actuation, the damper portion with the abutment surface 9531 and the inclined surface 1033 is arranged between the trigger element 240 and the contact pads 303*a* and 303*b*. The inclined surface 1033 is formed to enable or cause first-time and non-recurring sliding of the trigger element 240. The abutment surface 931 may be oriented at an acute angle or parallel to the inclined surface 1033. The abutment surface 931 at least is formed such that sliding back to the position prior to the assembly or first-time actuation is prevented.

During assembly or first-time actuation of the key module, the trigger element 240 can be deflected along the inclined surface 1033 and guided past the damper portion for the first and only time and thus slide past the damper portion. Additionally or alternatively, when the trigger element 240 is sliding across the inclined surface 1033, the damper portion, particularly the inclined surface 1033, can be deflected. Thus, in addition to or as an alternative to the trigger element 240, also the damper portion may comprise flexible material.

Figure 11:
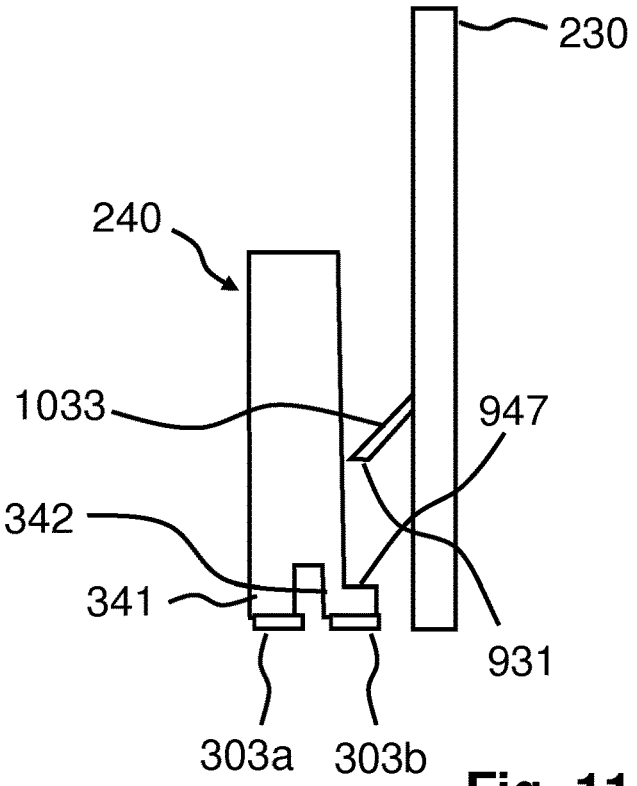
FIG. 11 shows a partially sectional view taken along line A-A in FIG. 9 of the subsection of the keyboard from FIG. 10 with the key module in an actuated position.

FIG. 11 shows a partially sectional view of the subsection of the keyboard from FIG. 10 with the key module in an actuated position. Here, the illustration in FIG. 11 corresponds to the illustration from FIG. 10 except for the key module being shown in the actuated position, wherein electric contact is established between contact fingers 341, 342 and the contact pads 303*a*, 303*b*. Here, the contact fingers 341, 342 and the rest portion 947 are arranged between the contact pads 303*a*, 303*b* and the damper portion with the abutment surface 931 and the inclined surface 1033 formed on the module housing 230. Also, the rest portion 947 is spaced from the damper portion, in particular the abutment surface 931, here. Starting from the state illustrated in FIG. 10 and moving to the state shown in FIG. 11, the rest portion 947 of the trigger element 240 has slid past on the inclined surface 1033 and the abutment surface 931 for the first and only time.

Figure 12:
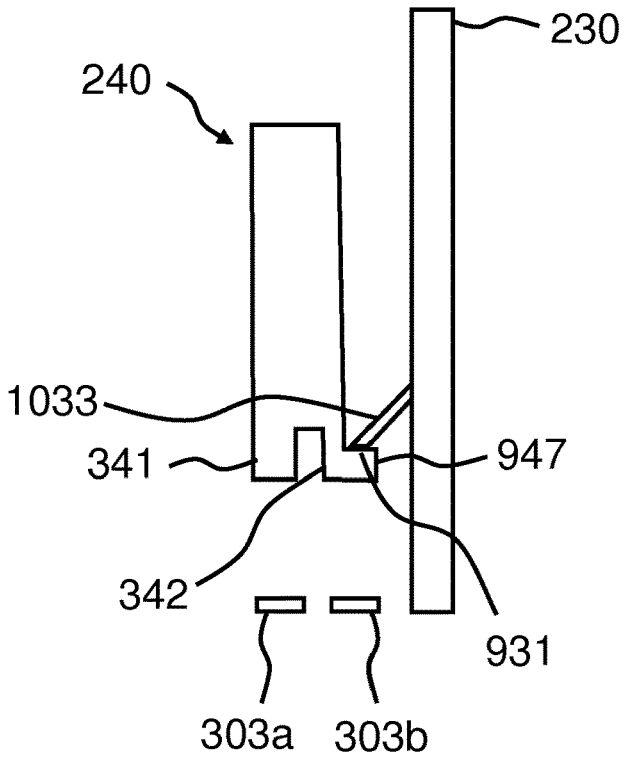
FIG. 12 shows a partially sectional view taken along line A-A in FIG. 9 of the subsection of the keyboard from FIG. 10 or FIG. 11 with the key module in a rest position.

FIG. 12 shows a partially sectional view of the subsection of the keyboard from FIG. 10 or FIG. 11 with the key module in a rest position. Here, the illustration in FIG. 12 corresponds to the illustration from FIG. 11, except that the key module is shown in the rest position, wherein the rest portion 947 of the trigger element 240 abuts on the abutment surface 931. Noise due to vibrations of the trigger element 240, in particular the contact fingers 341, 342, can thus be prevented. The trigger element 240, more specifically the rest portion 947, cannot slide back across the damper portion again to reach the state shown in FIG. 10, for example. The rest portion 947 engages behind the abutment surface 931, for example.

According to an embodiment and with reference to the previously described figures, in an assembly method for assembling the key module 110, the key tappet 220 with the trigger element 240 arranged thereon can be inserted into the module housing 230. Here, a relative movement of the key tappet 220 with the trigger element 240 with respect to the module housing 230 can be effected along an axis of the actuation movement. The trigger element 240 and/or the damper portion or the inclined surface 1033 also is deflected during this relative movement so that the trigger element 240 is guided past the damper portion and slides past the damper portion for the first and only time. The relative movement takes place when inserting the key tappet 220 including the trigger element 240 into the module housing 230 at least until the rest position is reached. By the trigger element 240 abutting on the abutment surface 931, return of the key tappet 220 or the trigger element 240 to a position like prior to assembly, see FIG. 10, is prevented.

An embodiment of the present invention again explained briefly in other words and in summary with reference to the previously described figures in the following.

The key module 110 or key element comprises the keycap 220 and the module housing 230. Furthermore, the key module 110 comprises a click mechanism. According to the embodiment illustrated, the click mechanism comprises the wire bracket to 650 and the projection portion 624 with the strike surface as a stop. Furthermore, the key module 110 comprises a contact mechanism. In the embodiment shown, the contact mechanism comprises the trigger element 240 with the three contact fingers 341, 342 and 343. According to another embodiment, also more contact fingers may be provided. In the family actuated state of the key module 110 or in its actuated position or at its second switching point, all three contact fingers 341, 342 and 343 arranged in one plane normal to an axis of the actuation movement. In the non-actuated state of the key module 110 or in its rest position, the keycap at 220 projects farthermost from the module housing 230, and the contact fingers 341, 342 and 343 are arranged in the key module 230 freely without contact to the circuit substrate 102 of the keyboard 100, wherein the contact fingers 341, 342 and 343 spaced from each other along the axis of the actuation movement. The first contact fingers 341 and the second contact fingers 342 of the contacts realizing the first switching point stop. In a mounted state of the keyboard 100, they are arranged more closely to the circuit substrate 102 of the keyboard 100 than the third contact finger 343, which realizes the second switching point.

An actuation procedure of the key module 110 is briefly described in the following. At first, the key module 110 is in the contactless state, as shown in FIG. 3A. The elastic means 660 urges the keycap at 220 away from the housing bottom to a housing stop not shown. The three contact fingers 341, 342 and 343 are arranged in the key tappet 220 freely and without contact to the circuit substrate 102, wherein the first contact finger 341 and the second contact finger 342 are spaced from the third contact finger 343 along an axis of the actuation movement. During the actuation process or the actuation movement, at first the first contact finger 341 and the second contact finger 342 hit the circuit substrate 102 or the first contact pad 303*a* and the second contact pad 303*b*. The first contact finger 341 and the second contact finger 342 are to be seen as electric bridge and electrically short the first contact pad 303*a* and the second contact pad 303*b* at the first switching point or after the first pre-travel path. When the key tappet 220 is actuated further, the second switching point can be realized. The third contact pad 303*c* on the circuit substrate 102 here is electrically shorted by the third contact finger 343 in connection with the first contact finger 341 and the second contact finger 342.

In summary, it is to be noted that two switching points can be realized by way of a three contact fingers 341, 342 and 343 spaced from each other along an axis of the actuation movement. The first switching point can be reached after a short pre-travel path and enable quick contact. The second switching point can be reached after a longer pre-travel path.

If an embodiment comprises an "and/or" connection between a first feature and a second feature, this may be read to mean that the embodiment comprises both the first feature and the second feature according to one embodiment and either only the first feature or only the second feature according to a further embodiment.

REFERENCE NUMERALS

100 keyboard
102 circuit substrate
104 fixing element
106 keycap
110 key module
220 key tappet
222 coupling portion
230 module housing
240 trigger element
341 first contact finger
342 second contact finger
343 third contact finger
303*a* first contact pad
303*b* second contact pad
303*c* third contact pad
625 projection portion
634 positioning protrusion
636 mounting portion
638 flange
644 first finger portion
645 second finger portion
650 wire bracket
660 elastic means
770 device for recognizing
772 detector
774 provider
781 first actuation signal
782 second actuation signal
783 further actuation signal
800 method for recognizing
810 step of detecting
820 step of providing
931 abutment surface
947 rest portion
1033 inclined surface

The invention claimed is:

1. Key module for a keyboard, wherein the key module comprises:

a key tappet;

a module housing, wherein the module housing is formed to movably accommodate the key tappet, in order to enable a translational actuation movement of the key tappet between a rest position and an actuated position relative to the module housing; and a trigger element for triggering an actuation signal of the key module in response to the actuation movement, the trigger element having a substantially L-shape with a body and cantilevered contact fingers that extend substantially perpendicular from the body, wherein the body of the trigger element is mounted to the key tappet, wherein the trigger element is a contactor for electrically shorting contact pads of a circuit substrate of the keyboard, wherein the contact fingers of the trigger element comprises three or more elastically deformable contact fingers for contacting the contact pads after different pre-travel paths in the course of the actuation movement;

wherein a first contact finger and a second contact finger are bent at a first angle relative to the body of the trigger element, wherein a third contact finger is bent at a second angle relative to the body of the trigger element, wherein the first angle is greater than the second angle.

2. Key module according to claim 1, wherein the contact fingers are formed to contact at least two of the contact pads with a distance offset with respect to each other and/or in a freely pre-definable sequence in the course of the actuation movement.

3. Key module according to claim 1, wherein the first contact finger is formed to contact a first contact pad after a first pre-travel path, wherein the second contact finger is formed to contact a second contact pad after the first pre-travel path, wherein the third contact finger is formed to contact a third contact pad after a second pre-travel path, wherein the second pre-travel path is longer than the first pre-travel path.

4. Key module according to claim 1, wherein the first contact finger and the second contact finger are formed as subsections of a first finger portion of the trigger element and the third contact finger is formed as a second finger portion of the trigger element, and/or wherein a separation gap between the first contact finger and the second contact finger is shorter than a separation gap between the second contact finger and the third contact finger.

5. Key module according to claim 1, wherein each of the contact fingers comprises a bent end portion for contacting one of the contact pads.

6. Key module according to claim 1, with a wire bracket for providing tactile and/or acoustic feedback, wherein the wire bracket is elastically deformable in the course of the actuation movement, wherein the wire bracket is bent with an overall bending angle of less than 360 degrees, wherein the wire bracket is fixed to the key tappet.

7. Key module according to claim 1, wherein the module housing is integrally formed, wherein the module housing comprises at least one positioning protrusion for positioning the key module on a circuit substrate of the keyboard, wherein the module housing comprises at least one mounting portion for mounting the key module in the keyboard with positive locking and/or non-positive locking.

8. Key module according to claim 1, wherein the module housing comprises an abutment surface, wherein the trigger element is arranged so as to abut on the abutment surface in the rest position of the key tappet.

9. Keyboard, wherein the keyboard comprises:

at least one key module according to claim 1; and the circuit substrate with the contact pads, wherein the at least one key module is arranged on the circuit substrate.

10. Keyboard according to claim 9, wherein the contact pads are electrically insulated from each other and/or arranged along a straight line.

11. Keyboard according to claim 9, wherein the at least one key module and the circuit substrate are connected to each other exclusively with positive locking and/or non-positive locking.

12. Keyboard according to claim 9, comprising a fixing element for fixing the at least one key module to the circuit substrate, wherein the fixing element is a keyframe between the circuit substrate and a keyboard top or is a keyboard top.

13. Method for recognizing actuation of a key module of a keyboard according to claim 9, wherein the method comprises the steps of:

detecting a number of contact pads of the circuit substrate of the keyboard contacted by the contact fingers; and providing a first actuation signal in response to a detected first number of contact pads contacted by the contact fingers and a second actuation signal in response to a detected second number different from the first number of contact pads contacted by the contact fingers, wherein each of the actuation signals represents a recognized actuation of the key module.

14. Keyboard according to claim 9, comprising a device for recognizing actuation of the key module, wherein the device is connected to the circuit substrate for signal transmission, wherein the device comprises a detector for detecting a number of contact pads of the circuit substrate of the keyboard contacted by the contact fingers and a provider for providing a first actuation signal in response to a detected first number of contact pads contacted by the contact fingers and a second actuation signal in response to a second number different from the first number of contact pads contacted by the contact fingers, wherein each of the actuation signals represents a recognized actuation of the key module.

15. Keyboard according to claim 14, wherein the detector is configured to detect at least a time interval between contact time instants at which different contact pads are contacted by the contact fingers, wherein the provider is configured to provide at least one further actuation signal depending on the at least one detected time interval using a determination rule, wherein the at least one further actuation signal represents a recognized actuation of the key module.

* * * * *